US007899672B2

(12) United States Patent
Qin et al.

(10) Patent No.: US 7,899,672 B2
(45) Date of Patent: Mar. 1, 2011

(54) METHOD AND SYSTEM FOR GENERATING SYNTHESIZED SPEECH BASED ON HUMAN RECORDING

(75) Inventors: Yong Qin, Beijing (CN); Liqin Shen, Beijing (CN); Wei Zhang, Beijing (CN); Weibin Zhu, Beijing (CN)

(73) Assignee: Nuance Communications, Inc., Burlington, MA (US)

( * ) Notice: Subject to any disclaimer, the term of this patent is extended or adjusted under 35 U.S.C. 154(b) by 1282 days.

(21) Appl. No.: 11/475,820

(22) Filed: Jun. 27, 2006

(65) Prior Publication Data

US 2007/0033049 A1 Feb. 8, 2007

(30) Foreign Application Priority Data

Jun. 28, 2005 (CN) ..... 2005 1 0079778

(51) Int. Cl.
*G10L 13/08* (2006.01)
*G10L 13/00* (2006.01)

(52) U.S. Cl. ..... 704/260; 704/258

(58) Field of Classification Search ..... None
See application file for complete search history.

(56) References Cited

U.S. PATENT DOCUMENTS 6,266,637 B1 * 7/2001 Donovan et al. ..... 704/258
2002/0133348 A1 9/2002 Pearson et al.
2004/0138887 A1 * 7/2004 Rusnak et al. ..... 704/260
2007/0192105 A1 * 8/2007 Neeracher et al. ..... 704/258

OTHER PUBLICATIONS

Natural Playback Modules (NPM), Nuance Professional Services, 5 pages, printed on Jun. 4, 2010.

* cited by examiner

*Primary Examiner*—Angela A Armstrong
(74) *Attorney, Agent, or Firm*—Wolf, Greenfield & Sacks, P.C.

(57) ABSTRACT

A method and system that incorporates human recording with a TTS system to generate synthesized speech with high quality by searching over a database of pre-recorded utterances to select an utterance best matching text content to be synthesized into speech; dividing the best-matched utterance into a plurality of segments to generate remaining segments that are the same as corresponding parts of the text content and difference segments that are different from corresponding parts of the text content; synthesizing speech for the parts of the text content corresponding to the difference segments; and splicing the synthesized speech segments with the remaining segments of the best-matched utterance.

15 Claims, 3 Drawing Sheets

METHOD AND SYSTEM FOR GENERATING SYNTHESIZED SPEECH BASED ON HUMAN RECORDING

TECHNICAL FIELD OF THE INVENTION

The present invention relates to speech synthesis technologies, particularly, to a method and system for incorporating human recording with a Text to Speech (TTS) system to generate high-quality synthesized speech.

BACKGROUND OF THE INVENTION

Speech is the most convenient way for humans to communicate with each other. With the development of speech technology, speech has become the most convenient interface between humans and machines/computers. The speech technology mainly includes speech recognition and text-to-speech (TTS) technologies.

The existing TTS systems, such as formant and small-corpus concatenative TTS systems, deliver speech with a quality that is unacceptable to most listeners. Recent development in large-corpus concatenative TTS systems makes synthesized speech more acceptable, enabling human-machine interactive systems to have wider applications. With the improvement of the TTS systems' quality, various human-machine interactive systems, such as e-mail readers, news readers, in-car information systems, etc., have become feasible.

However, with the wider and wider application of various human-machine interactive systems, people hope to have the speech output quality of these human-machine interactive systems further improved through research on TTS systems.

Generally, a general-purpose TTS system tries to mimic human speech with speech units at a very low level, such as phone, syllable, etc. Choosing such small speech units is actually a compromise between the TTS system's quality and flexibility. Generally speaking, the TTS system that uses small speech units like phones or syllables may deal with any text content with a relatively reasonable number of joining points, so it has good flexibility, while the TTS system using big speech units like words, phrases, etc. may improve quality because of a relatively small number of joining points between the speech units, but the drawback of this TTS system is that the big speech units would cause difficulties in dealing with "out of vocabulary (OOV)" cases, that is, the TTS system using big speech units has poor flexibility.

As to the application of the synthesized speech, it may be found that some applications have a very narrow use domain, for instance, a weather-forecast IVR (interactive voice responding) system, a stock quoting IVR system, a flight-information querying IVR system, etc. These applications highly depend on their use domains and have a very limited number of synthesizing patterns. In such cases, the TTS system has an opportunity to take advantages of the big speech units like word/phrase so as to avoid too many joining points and can mimic speech with high quality.

In the prior art, there are many TTS systems based on the word/phrase splicing technology. The U.S. Pat. No. 6,266,637 assigned to the same assignee of the present invention discloses a TTS system based on the word/phrase splicing technology. Such a TTS system splices all the words or phrases together to construct a remarkably natural speech. When such a TTS system based on the word/phrase splicing technology cannot find corresponding words or phrases in its dictionaries, it will use the general-purpose TTS system to generate the synthesized speech corresponding to the words or phrases. Although the TTS system with word/phrase splicing technology may search for word or phrase segments from different speeches, it cannot guarantee the continuity and naturalness of the synthesized speech.

It is well known that, as compared with the synthesized speech based on the word/phrase splicing technology, human speech is the most natural voice. There is a lot of syntactic and semantic information embedded in human speech in a completely natural way. When researchers continuously improve the general-purpose TTS systems, they also acknowledge that there is no perfect substitute for pre-recorded human speech. Thus, in order to further improve the quality of the synthesized speech, in some specific application domains, the bigger speech units, such as sentences, should be fully used, so as to guarantee the continuity and naturalness of the synthesized speech. However, up to now, there is still not any technical solution that directly utilizes such bigger speech units to generate synthesized speech with high quality.

SUMMARY OF THE INVENTION

The invention is proposed in view of the above-mentioned technical problems. Its purpose is to provide a method and system that incorporates human recording with a TTS system to generate synthesized speech with high quality. The method and system according to the present invention makes good use of the syntactic and semantic information embedded in human speech thereby improving the quality of the synthesized speech and minimizing the number of joining points between the speech units of the synthesized speech.

According to an aspect of the present invention, there is provided a method for generating synthesized speech, comprising the steps of:

searching over a database that contains pre-recorded utterances to find out an utterance best matching a text content to be synthesized into speech;

dividing the best-matched utterance into a plurality of segments to generate remaining segments that are the same as corresponding parts of the text content and difference segments that are different from corresponding parts of the text content;

synthesizing speech for the parts of the text content corresponding to the difference segments; and splicing the synthesized speech segments of the parts of the text content corresponding to the difference segments with the remaining segments of the best-matched utterance.

Preferably, the step of searching for the best-matched utterance comprises: calculating edit-distances between the text content and each utterance in the database; selecting the utterance with minimum edit-distance as the best-matched utterance; and determining edit operations for converting the best-matched utterance into the speech of the text content.

Preferably, calculating an edit-distance is performed as follows:

$$E(i, j) = \min\begin{Bmatrix} E(i-1, j-1) + Dis(s_i, t_j) \\ E(i, j-1) + Del(t_j) \\ E(i-1, j) + Ins(s_i) \end{Bmatrix}$$

where $S=s_1 \ldots s_i \ldots s_N$ represents a sequence of the words in the utterance, $T=t_1 \ldots t_j \ldots t_M$ represents a sequence of the words in the text content, E(i, j) represents the edit-distance for converting $s_1 \ldots s_i$ into $t_1 \ldots t_j$, $Dis(s_i,t_j)$ represents the substitution penalty when replacing word $s_i$ in the utterance with word $t_j$ in the text content, $Ins(s_i)$ represents the insertion penalty for inserting $s_i$ and $Del(t_j)$ represents the deletion penalty for deleting $t_j$.

Preferably, the step of determining edit operations comprises: determining editing locations and corresponding editing types.

Preferably, the step of dividing the best-matched utterance into a plurality of segments comprises: according to the determined editing locations, chopping out the segments to be edited from the best-matched utterance, wherein the segments to be edited are the difference segments and the other segments are the remaining segments.

According to another aspect of the present invention, there is provided a system for generating synthesized speech, comprising:

a speech database for storing pre-recorded utterances;

a text input device for inputting a text content to be synthesized into speech;

a searching means for searching over the speech database to select an utterance best matching the inputted text content;

a speech splicing means for dividing the best-matched utterance into a plurality of segments to generate remaining segments that are the same as corresponding parts of the text content and difference segments that are different from corresponding parts of the text content, synthesizing speech for the parts of the inputted text content corresponding to the difference segments, and splicing the synthesized speech segments with the remaining segments; and a speech output device for outputting the synthesized speech corresponding to the inputted text content.

Preferably, the searching means further comprises: a calculating unit for calculating edit-distances between the text content and each utterance in the speech database; a selecting unit for selecting the utterance with minimum edit-distance as the best-matched utterance; and a determining unit for determining edit operations for converting the best-matched utterance into the speech of the text content.

Preferably, the speech splicing means further comprises: a dividing unit for dividing the best-matched utterance into a plurality of the remaining segments and the difference segments; a speech synthesizing unit for synthesizing the speech for the parts of the inputted text content corresponding to the difference segments; and a splicing unit for splicing the synthesized speech segments with the remaining segments.

DETAILED DESCRIPTION OF THE INVENTION

It is believed that the above-mentioned and other objects, features and advantages will become more apparent through the following description of the preferred embodiments of the present invention with reference to the drawings.

Figure 1:
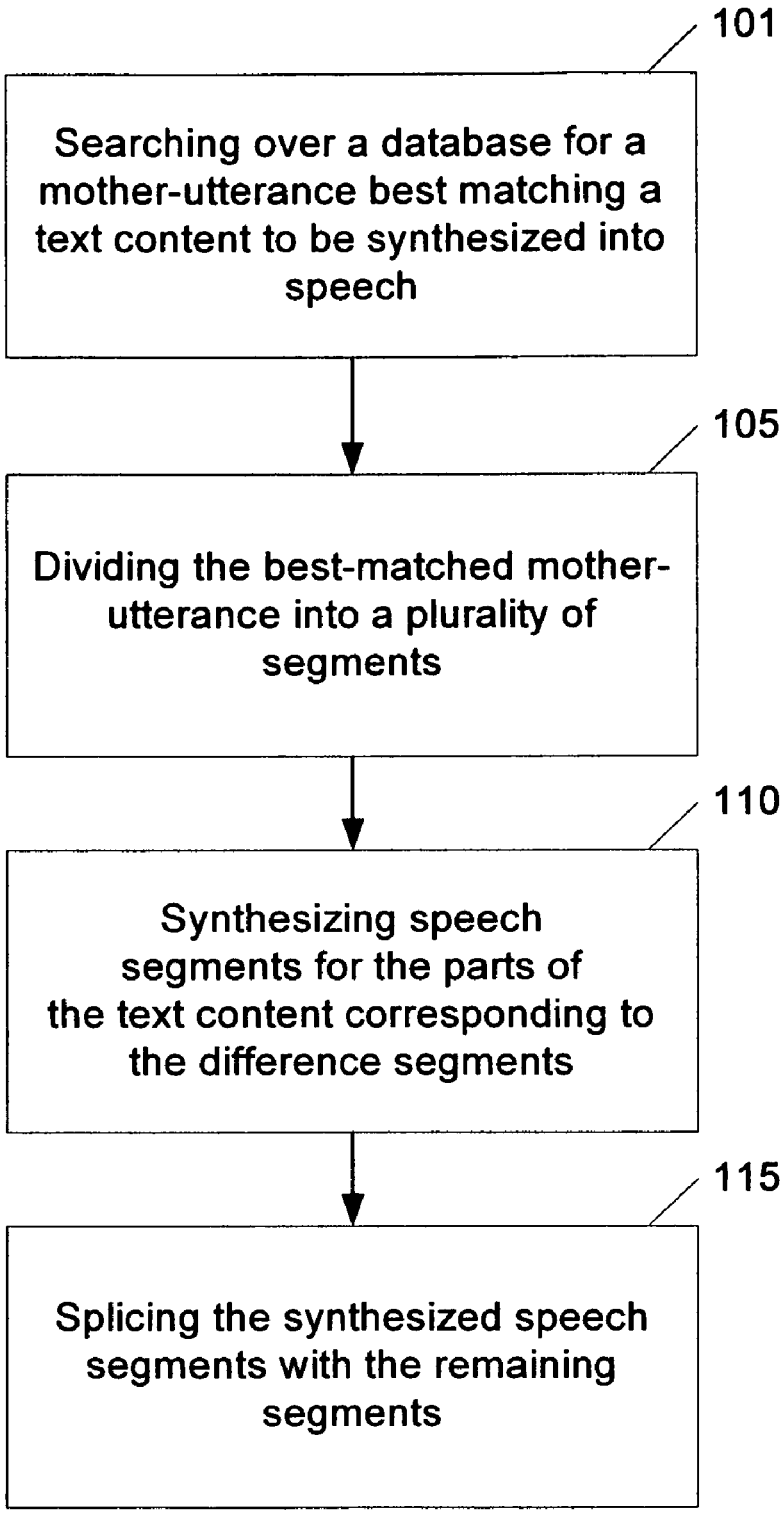
FIG. 1 is a flowchart of the method for generating synthesized speech according to a preferred embodiment of the present invention.

FIG. 1 is a flowchart of the method for generating synthesized speech according to an embodiment of the present invention. As shown in FIG. 1, at Step 101, a best-matched utterance for a text content to be synthesized into speech is searched over a database that contains pre-recorded utterances, also referred to as "mother-utterances". The utterances in the database contain the sentence texts frequently used in a certain application domain and the speech corresponding to these sentences is pre-recorded by the same speaker.

Figure 2:
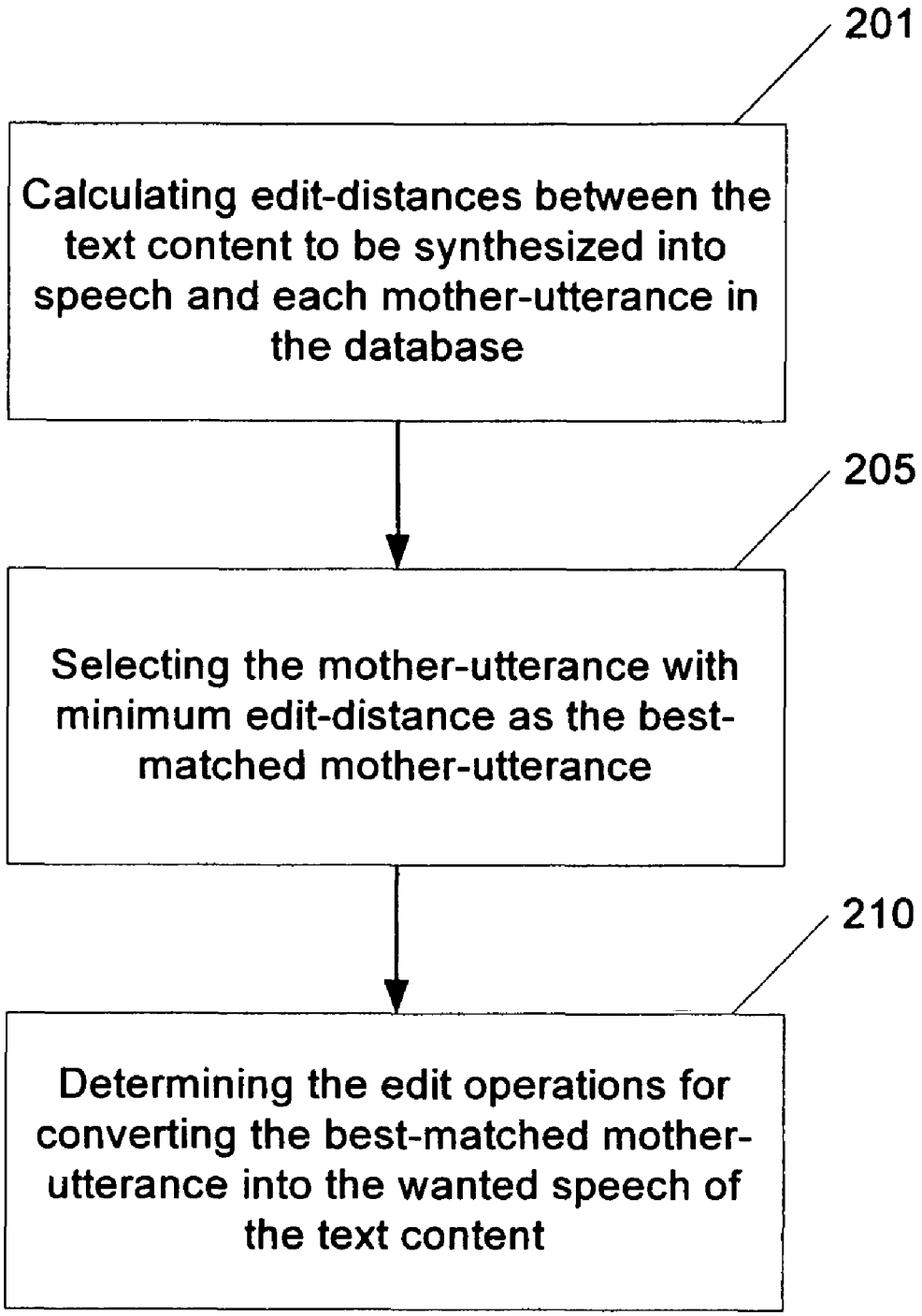
FIG. 2 is a flowchart showing the step of searching for the best-matched utterance in the method shown in FIG. 1.

In this step, searching for the best-matched utterance is implemented based on an edit-distance algorithm, of which the details are shown in FIG. 2. First, at Step 201, edit-distances between the text content to be synthesized into speech and each pre-recorded utterance in the database are calculated. Usually, an edit-distance is used to calculate the similarity between any two strings. In the present embodiment, the string is a sequence of lexical words (LW). Suppose a source LW sequence is $S=s_1 \ldots s_i \ldots s_N$ and a target LW sequence is $T=t_1 \ldots t_j \ldots t_M$, then the edit-distance is used to define the metric of similarity between these two LW sequences. Several criteria are used to define the measure of the distance between $s_i$ in the source LW and $t_j$ in the target LW, denoted as $Dis(s_i, j_j)$. The simplest way is to conduct string matching between these two LW sequences. If they are equal to each other, the distance is zero; otherwise the distance is set as 1. Of course, there are more complicated methods for defining the distance between two sequences, since this is out of the scope of the present invention, the details will not be discussed here.

When comparing one LW sequence with another, usually these two LW sequences do not correspond to each other one to one. Usually, it can be found that some word deletion and/or word insertion operations are needed to attain complete correspondence between the two sequences. Therefore, the edit-distance can be used to model the similarity between two LW sequences, wherein editing is a sequence of operations, including substitution, insertion and deletion. The cost for editing the source LW sequence $S=s_1 \ldots s_i \ldots s_N$ and converting it into the target LW sequence $T=t_1 \ldots t_j \ldots t_M$ is the sum of the costs for all the required operations, and the edit-distance is the minimum cost for all the possible editing sequences for converting the source sequence $s_1 \ldots s_i \ldots s_N$ into the target sequence $t_1 \ldots t_j \ldots t_M$, which may be calculated by means of a dynamic programming method.

In the present embodiment, suppose $E(i, j)$ represents the edit-distance, the source LW sequence $S=s_1 \ldots s_i \ldots s_N$ is a sequence of the words in the utterance, and the target LW sequence $T=t_1 \ldots t_j \ldots t_M$ is a sequence of the words in the text content to be synthesized into speech, the following formula may be used to calculate the edit-distance:

$$E(i, j) = \min\begin{Bmatrix} E(i-1, j-1) + Dis(s_i, t_j) \\ E(i, j-1) + Del(t_j) \\ E(i-1, j) + Ins(s_i) \end{Bmatrix}$$

where $Dis(s_i,t_j)$ represents the substitution penalty when replacing word $s_i$ in the utterance with word $t_j$ in the text content, $Ins(s_i)$ represents the insertion penalty for inserting $s_i$ and $Del(t_j)$ represents the deletion penalty for deleting $t_j$.

Next, at Step 205, the utterance with minimum edit-distance is selected as the best-matched utterance, which could guarantee a minimum number of subsequent splicing operations to avoid too many joining points. The best-matched utterance, as the utterance of the text content to be synthesized into speech, would be able to form the desired speech after appropriate modifications. At Step 210, edit operations are determined for converting the best-matched utterance into the desired speech of the text content. Usually, the best-matched utterance is not identical with the desired speech of the text content, i.e., there are certain differences between them. Appropriate edit operations of the best-matched utterance are necessary in order to obtain the desired speech. As mentioned above, the edit is a sequence of operations, including substitution, insertion and deletion. In this step, editing locations and corresponding editing types need to be determined for the best-matched utterance, and the editing locations may be defined by the left and right boundaries of the content to be edited.

With the above-mentioned steps, the utterance that best matches the text content to be synthesized into speech may be obtained, and the editing locations and the corresponding editing types for editing the best-matched utterance are also obtained.

Turning back to FIG. 1, at Step 105, the best-matched utterance is divided into a plurality of segments according to the determined editing locations, wherein the segments that are different from corresponding parts of the text content and are to be edited are the difference segments, including substitution segments, insertion segments and deletion segments; the other segments that are the same as corresponding parts of the text content are the remaining segments, which will be further used to synthesize speech. In this way, the resultant synthesized speech can inherit the exactly same prosodic structure as that of human speech, such as prominence, word-grouping fashion, syllable duration, etc. As a result, the quality of speech is improved and the speech becomes easy to be accepted by the listeners. The location of division becomes the joining point for the subsequent splicing operation.

At Step 110, the speech segments for the parts of the text content corresponding to the difference segments are synthesized. This may be implemented by the text to speech method in the prior art. At Step 115, the synthesized speech segments are spliced with the remaining segments at the corresponding join/joint points to generate the desired speech of the text content. A key point in the splicing operation is how to join the remaining segments with the newly synthesized speech segments at the joining points seamlessly and smoothly. The segment-joining technology itself is pretty mature and the acceptable joining quality can be achieved by carefully handling several issues including pitch-synchronization, spectrum smoothing and energy contour smoothing, etc.

From the above description it can be seen that in the utterance based splicing TTS method of the present embodiment, since the utterance is the pre-recorded human speech, the prosodic structure of human speech, such as prominence, word-grouping fashion, syllable duration, etc., can be inherited by the synthesized speech, so that the quality of the synthesized speech is greatly improved. Furthermore, the method can guarantee maintenance of the original sentence skeleton of the utterance by searching for the whole sentence segmentation at the sentence level. In addition, using the edit-distance algorithm to search for the best-matched utterance may guarantee output of the best-matched utterance with a minimum number of edit operations, as compared to either phone/syllable based general-purpose TTS methods or word/phrase based general-purpose TTS methods, and the present invention may avoid a lot of joining points.

Next, an example in which the method according to the present invention is applied to the specific application domain such as weather forecasting will be described. First, storing the utterances of the sentence patterns frequently used in weather forecasting in a database is necessary. These sentence patterns are, for instance:

Pattern 1: Beijing; sunny; highest temperature 30 degrees centigrade; lowest temperature 20 degrees centigrade.

Pattern 2: New York; cloudy; highest temperature 25 degrees centigrade; lowest temperature 18 degrees centigrade.

Pattern 3: London; light rain; highest temperature 22 degrees centigrade; lowest temperature 16 degrees centigrade.

After the above-mentioned frequently-used sentence patterns have been designed or collected, the utterance of each pattern is recorded by the same speaker, denoted as utterance 1, utterance 2 and utterance 3 respectively. Then the utterances are stored in the database.

Suppose that a speech of the text content about Seattle's weather condition needs to be synthesized, for instance, "Seattle; sunny; highest temperature 28 degrees centigrade; lowest temperature 23 degrees centigrade" (for the sake of simplicity, hereinafter referred to as a "target utterance"). First, above-mentioned database is searched for an utterance that best matches the target utterance. Then, edit-distances between the target utterance and each utterance in the database are calculated according to above-mentioned edit-distance algorithm. Taking utterance 1 as an example, the source LW sequence is "Beijing; sunny; highest temperature 30 degrees centigrade; lowest temperature 20 degrees centigrade", the target LW sequence is "Seattle; sunny; highest temperature 28 degrees centigrade; lowest temperature 23 degrees centigrade", then the edit-distance between them is 3. Similarly, the edit-distance between the target utterance and the utterance 2 is 4, and the edit-distance between the target utterance and the utterance 3 is also 4. Thus, the utterance with minimum edit-distance is the utterance 1. Furthermore, according to the edit-distance, it is known that 3 edit operations are needed on the utterance 1, the edit locations are "Beijing", "30" and "20" respectively, and all the edit operations are substitution operations, that is, substituting "Beijing" with "Seattle", "30" with "28", and "20" with "23".

After that, according to the edit locations, the utterance 1 is divided into 8 segments, that is, "Beijing", "Sunny", "Highest temperature", "30", "degrees", "lowest temperature", "20", and "degrees centigrade", wherein "Beijing", "30" and "20" are the difference segments which are different from the text content and are to be edited, and other segments "sunny", "highest temperature", "degrees", "lowest temperature" and "degrees centigrade" are the remaining segments, the joining points are located in the left boundary of "sunny", the right boundary of "highest temperature", the left boundary of "degrees", the right boundary of "lowest temperature" and the left boundary of "degrees centigrade" respectively.

The speech is synthesized for the parts of the target utterance corresponding to the difference segments, that is, "Seattle", "28" and "23". Here, the speech is synthesized by means of the speech synthesis methods in the prior art, such as the general-purpose TTS method, so as to obtain the synthesized speech segments. By splicing the synthesized speech segments with the remaining segments at the corresponding joining points, the synthesized speech of the target utterance "Seattle; sunny; highest temperature 28 degrees; lowest temperature 23 degrees" is formed.

Figure 3:
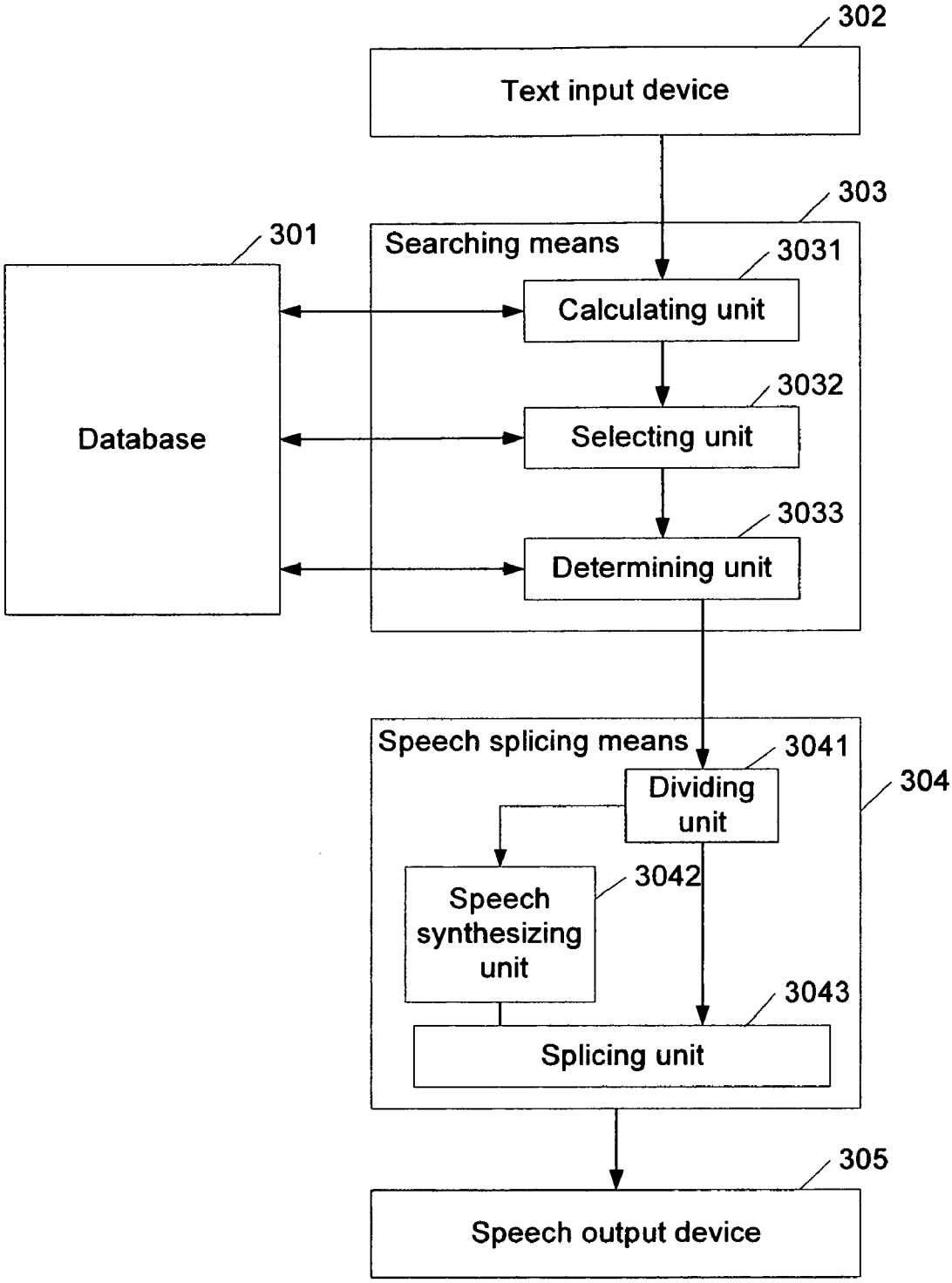
FIG. 3 schematically shows a system for generating synthesized speech according to a preferred embodiment of the present invention.

FIG. 3 schematically shows a system for synthesizing speech according to a preferred embodiment of the present invention. As shown in FIG. 3, the system for synthesizing speech comprises a speech database 301, a text input device 302, a searching means 303, a speech splicing means 304 and a speech output device 305. Pre-recorded utterances are stored in the speech database 301 for providing the utterances of the sentences frequently used in a certain application domain.

After a text content to be synthesized into speech is inputted through the text input device 302, the searching means 303 accesses the speech database 301 to search for a utterance best matching the inputted text content, and determines edit operations for converting the best-matched utterance into the speech of the inputted text content, including the editing locations and the corresponding editing types, after finding out the best-matched utterance. The best-matched utterance and the corresponding information of the edit operations are outputted to the speech splicing means 304, whereby the best-matched utterance is divided into a plurality of segments (remaining segments and difference segments), and a kind of general-purpose TTS method is invoked to synthesize the speech for the parts of the inputted text content corresponding to the difference segments to obtain the corresponding synthesized speech segments, after which the synthesized speech segments are spliced with the remaining segments to obtain the synthesized speech corresponding to the inputted text content. Finally, the synthesized speech corresponding to the inputted text content is outputted through the speech output device 305.

In the present embodiment, the searching means 303 is implemented based on the edit-distance algorithm, further comprising: a calculating unit 3031 for calculating an edit-distance, which calculates the edit-distances between the inputted text content and each utterance in the speech database 301; a selecting unit 3032 for selecting the best-matched utterance, which selects the utterance with minimum edit-distance as the best-matched utterance; and a determining unit 303 for determining the edit operations, which determines the editing locations and the corresponding editing types for the best-matched utterance, wherein the editing locations are defined by the left and right boundaries of the parts of the inputted text content to be edited.

Moreover, the speech splicing means 304 further comprises: a dividing unit 3041 for dividing the best-matched utterance into a plurality of the remaining segments and the difference segments, in which the dividing operations are performed based on the editing locations; a speech synthesizing unit 3042 for synthesizing the speech for the parts of the inputted text content corresponding to the difference segments by means of the general-purpose TTS method in the prior art; and a splicing unit 3043 for splicing the synthesized speech segments with the remaining segments.

The components of the system for synthesizing speech of the present embodiment may be implemented with hardware or software modules or their combinations.

It can be seen from the above description that by using the system for synthesizing speech of the present embodiment, the synthesized speech can be generated based on the pre-recorded utterances, so that the synthesized speech could inherit the prosodic structure of human speech and the quality of the synthesized speech is greatly improved. Moreover, using the edit-distance algorithm to search for the best-matched utterance could guarantee output of the best-matched utterance with a minimum number of edit operations, thereby avoiding a lot of joining points.

The invention claimed is:

1. A computer-implemented method for generating synthesized speech from input text, the method comprising:

selecting a best-matched pre-recorded utterance from a plurality of pre-recorded utterances, wherein the selecting is based, at least in part, on a degree of matching between the input text and texts associated with the plurality of pre-recorded utterances;

dividing the best-matched pre-recorded utterance into a plurality of segments comprising remaining segments that match corresponding parts of the input text and difference segments that do not match corresponding parts of the input text;

synthesizing speech for parts of the input text corresponding to the difference segments in the selected best-matched pre-recorded utterance to generate synthesized speech segments; and splicing the synthesized speech segments of the parts of the input text corresponding to the difference segments with the remaining segments of the selected best-matched pre-recorded utterance to generate the synthesized speech for the input text.

2. The method according to claim 1, wherein selecting a best-matched pre-recorded utterance comprises:

calculating an edit-distance between the input text and each of the plurality of pre-recorded utterances;

selecting the pre-recorded utterance with a minimum edit-distance as the best-matched pre-recorded utterance; and determining at least one edit operation for converting the best-matched pre-recorded utterance into the synthesized speech for the input text.

3. The method according to claim 2, wherein calculating an edit-distance is performed as follows:

$$E(i, j) = \min\begin{Bmatrix} E(i-1, j-1) + Dis(s_i, t_j) \\ E(i, j-1) + Del(t_j) \\ E(i-1, j) + Ins(s_i) \end{Bmatrix}$$

where $S=s_1 \ldots s_i \ldots s_N$ represents a sequence of words in the pre-recorded utterance, $T=t_1 \ldots t_j \ldots t_M$ represents a sequence of words in the input text, $E(i, j)$ represents an edit-distance for converting, $s_1 \ldots s_i$ into $t_1 \ldots t_j$, $Dis(s_i, t_j)$ represents a substitution penalty when replacing word $s_i$ in the pre-recorded utterance with word $t_j$ in the input text, $Ins(s_i)$ represents an insertion penalty for inserting $s_i$ and $Del(t_j)$ represents a deletion penalty for deleting $t_j$.

4. The method according to claim 2, wherein determining at least one edit operation comprises:

determining at least one editing location and at least one corresponding editing type.

5. The method according to claim 4, wherein dividing the best-matched pre-recorded utterance into a plurality of segments comprises:

according to the determined at least one editing location, chopping out at least one edit segment to be edited from the best-matched pre-recorded utterance, wherein the include the at least one edit segment.

6. A system for generating synthesized speech for input text, the system comprising:

at least one storage device comprising a plurality of pre-recorded utterances; and at least one computer configured to:

select a best-matched pre-recorded utterance from a plurality of pre-recorded utterances, wherein the selecting is based, at least in part, on a degree of matching between the input text and texts associated with the plurality of pre-recorded utterances;

divide the best-matched pre-recorded utterance into a plurality of segments comprising remaining segments that match corresponding parts of the input text and difference segments that do not match corresponding parts of the input text;

synthesize speech for parts of the input text corresponding to the difference segments in the selected best-matched pre-recorded utterance to generate synthesized speech segments; and splice the synthesized speech segments with the remaining segments to generate synthesized speech for the input text.

7. The system according to claim 6, wherein the at least one computer is further configured to:

calculate an edit-distance between the input text and each of the plurality of pre-recorded utterances in the at least one storage device;

select the pre-recorded utterance with minimum edit-distance as the best-matched utterance; and determine at least one edit operation for converting the best-matched pre-recorded utterance into the synthesized speech for the input text.

8. The system according to claim 7, wherein the edit-distance is calculated as follows:

$$E(i, j) = \min\begin{Bmatrix} E(i-1, j-1) + Dis(s_i, t_j) \\ E(i, j-1) + Del(t_j) \\ E(i-1, j) + Ins(s_i) \end{Bmatrix}$$

where $S=s_1 \ldots s_i \ldots s_N$ represents a sequence of words in the pre-recorded utterance, $T=t_1 \ldots t_j \ldots t_M$ represents a sequence of words in the input text, E(i, j) represents an edit-distance for converting, $s_1 \ldots s_i$ into $t_1 \ldots t_j$, $Dis(s_i, t_j)$ represents a substitution penalty when replacing word $s_i$ in the pre-recorded utterance with word $t_j$ in the input text, $Ins(s_i)$ represents an insertion penalty for inserting $s_i$ and $Del(t_j)$ represents a deletion penalty for deleting $t_j$.

9. The system according to claim 7, wherein determining at least one edit operation comprises determining at least one editing location and at least one corresponding editing type.

10. The system according to claim 9, wherein the at least one computer is further configured to:

chop out at least one edit segment to be edited from the best-matched pre-recorded utterance according to the determined at least one editing location, wherein the difference segments include the at least one edit segment.

11. A machine-readable program storage device tangibly embodying a program of instructions that, when executed by the machine, perform a method for generating synthesized speech from input text, the method comprising:

selecting a best-matched pre-recorded utterance from a plurality of pre-recorded utterances, wherein the selecting is based, at least in part, on a degree of matching between the input text and texts associated with the plurality of pre-recorded utterances;

dividing the best-matched pre-recorded utterance into a plurality of segments comprising remaining segments that match corresponding parts of the input text and difference segments that do not match corresponding parts of the input text;

synthesizing speech for parts of the input text corresponding to the difference segments in the selected best-matched pre-recorded utterance to generate synthesized speech segments; and splicing the synthesized speech segments of the parts of the input text corresponding to the difference segments with the remaining segments of the selected best-matched pre-recorded utterance to generate the synthesized speech for the input text.

12. The device according to claim 11, wherein selecting a best-matched pre-recorded utterance comprises:

calculating an edit-distance between the input text and each of the plurality of pre-recorded utterances;

selecting the pre-recorded utterance with a minimum edit-distance as the best-matched pre-recorded utterance; and determining at least one edit operation for converting the best-matched pre-recorded utterance into the synthesized speech for the input text.

13. The device according to claim 12, wherein calculating an edit-distance is performed as follows:

$$E(i, j) = \min\begin{Bmatrix} E(i-1, j-1) + Dis(s_i, t_j) \\ E(i, j-1) + Del(t_j) \\ E(i-1, j) + Ins(s_i) \end{Bmatrix}$$

where $S=s_1 \ldots s_i \ldots s_N$ represents a sequence of words in the pre-recorded utterance, $T=t_1 \ldots t_j \ldots t_M$ represents a sequence of words in the input text, E(i, j) represents an edit-distance for converting, $s_1 \ldots s_i$ into $t_1 \ldots t_j$, $Dis(s_i, t_j)$ represents a substitution penalty when replacing word $s_i$ in the pre-recorded utterance with word $t_j$ in the input text, $Ins(s_i)$ represents an insertion penalty for inserting $s_i$ and $Del(t_j)$ represents a deletion penalty for deleting $t_j$.

14. The device according to claim 12, wherein determining at least one edit operation comprises:

determining at least one editing location and at least one corresponding editing type.

15. The device according to claim 14, wherein dividing the best-matched pre-recorded utterance into a plurality of segments comprises:

according to the determined at least one editing location, chopping out at least one edit segment to be edited from the best-matched pre-recorded utterance, wherein the difference segments include the at least one edit segment.

* * * * *